US006483481B1

(12) United States Patent
Sievenpiper et al.

(10) Patent No.: US 6,483,481 B1
(45) Date of Patent: Nov. 19, 2002

(54) TEXTURED SURFACE HAVING HIGH ELECTROMAGNETIC IMPEDANCE IN MULTIPLE FREQUENCY BANDS

(75) Inventors: Daniel Sievenpiper, Los Angeles; James H. Schaffner, Chatsworth, both of CA (US)

(73) Assignee: Hrl Laboratories, LLC, Malibu, CA (US)

( * ) Notice: Subject to any disclaimer, the term of this patent is extended or adjusted under 35 U.S.C. 154(b) by 0 days.

(21) Appl. No.: 09/713,119

(22) Filed: Nov. 14, 2000

(51) Int. Cl.[7] ..... H01Q 15/02

(52) U.S. Cl. ..... 343/909; 343/700 MS; 343/853

(58) Field of Search ..... 343/700 MS, 822, 343/829, 846, 853, 860, 909; H01Q 15/02

(56) References Cited

U.S. PATENT DOCUMENTS

| | | | |
|---|---|---|---|
| 3,267,480 A | 8/1966 | Lerner | 343/911 |
| 3,810,183 A | 5/1974 | Krutsinger et al. | 343/708 |
| 3,961,333 A | 6/1976 | Purinton | 343/872 |

(List continued on next page.)

FOREIGN PATENT DOCUMENTS

| | | |
|---|---|---|
| DE | 196 00 609 | 4/1997 |
| EP | 0 539 297 | 4/1993 |
| EP | 1 120 856 | 8/2001 |
| FR | 2 785 476 | 5/2000 |
| GB | 2 281 662 | 3/1995 |
| GB | 2 328 748 | 3/1999 |
| WO | 94/00891 | 1/1994 |
| WO | 96/29621 | 9/1996 |
| WO | 98/21734 | 5/1998 |
| WO | 99/50929 | 10/1999 |
| WO | 00/44012 | 7/2000 |

OTHER PUBLICATIONS

Balanis, C., "Aperture Antennas", *Antenna Theory, Analysis and Design*, 2nd Edition, (New York, John Wiley & Sons, 1997), Chap. 12, pp. 575–597.

Balanis, C., "Microstrip Antennas", *Antenna Thoery, Analysis and Design*, 2nd Edition, (New York, John Wiley & Sons, 1997), Chap. 14, pp. 722–736.

Cogard, J., "Alignment of Nematic Liquid Crystals and Their Mixtures" *Mol. Cryst. Liq, Cryst. Suppl. 1*, 1 (1982)pp. 1–74.

Doane, J.W., et al., "Field Controlled Light Scattering from Nematic Microdroplets", *Appl. Phys. Lett.*, vol. 48 (Jan. 1986) pp. 269–271.

Jensen, M.A. et al., "EM Interaction of Handset Antennas and a Human in Personal Communications", *Proceedings of the IEEE*, vol. 83, No. 1 (Jan. 1995) pp. 7–17.

Jensen, M.A., et al., "Performance Analysis of Antennas for Hand–held Transceivers using FDTD", *IEEE Transactions on Antennas and Propagation*, vol. 42, No. 8 (Aug. 1994) pp. 1106–1113.

Ramos, S., et al., *Fields and Waves in Communication Electronics*, 3rd Edition (New York, John Wiley & Sons, 1994) Section 9.8–9.11, pp. 476–487.

(List continued on next page.)

*Primary Examiner*—Tho Phan
(74) *Attorney, Agent, or Firm*—Ladas & Parry

(57) ABSTRACT

A high impedance surface having a reflection phase of zero in multiple frequency bands and a method of making same. The high impedance surface includes a ground plane; a plurality of conductive plates disposed in a first array spaced a distance from the ground plane, the distance being less than a wavelength of the radio frequency beam, said first array having a first lattice constant; and a plurality of conductive elements associated with said plurality of conductive plates, said plurality of conductive elements defining a second array, said second array having a lattice constant greater than the lattice constant of the first array.

46 Claims, 7 Drawing Sheets

U.S. PATENT DOCUMENTS

| | | | | | |
|---|---|---|---|---|---|
| 4,150,382 | A | | 4/1979 | King | 343/754 |
| 4,266,203 | A | | 5/1981 | Saudreau et al. | 333/91 |
| 4,387,377 | A | | 6/1983 | Kandler | 343/756 |
| 4,594,595 | A | | 6/1986 | Struckman | 343/770 |
| 4,737,795 | A | | 4/1988 | Nagy et al. | 343/712 |
| 4,749,996 | A | | 6/1988 | Tresselt | 343/700 |
| 4,782,346 | A | | 11/1988 | Sharma | 343/795 |
| 4,829,309 | A | * | 5/1989 | Tsukamoto et al. | 343/700 MS |
| 4,835,541 | A | | 5/1989 | Johnson et al. | 343/713 |
| 4,843,400 | A | | 6/1989 | Tsao et al. | 343/700 |
| 4,843,403 | A | | 6/1989 | Lalezari et al. | 343/767 |
| 4,855,704 | A | | 8/1989 | Diaz et al. | 343/767 |
| 4,905,014 | A | | 2/1990 | Gonzalez et al. | |
| 5,021,795 | A | | 6/1991 | Masiulis | 343/700 |
| 5,023,623 | A | | 6/1991 | Kreinheder et al. | 343/725 |
| 5,081,466 | A | | 1/1992 | Bitter Jr. | 343/767 |
| 5,115,217 | A | | 5/1992 | McGrath et al. | 333/246 |
| 5,146,235 | A | | 9/1992 | Frese | 343/895 |
| 5,158,611 | A | | 10/1992 | Ura et al. | 106/499 |
| 5,208,603 | A | | 5/1993 | Yee | 343/909 |
| 5,268,701 | A | | 12/1993 | Smith | 343/767 |
| 5,287,118 | A | | 2/1994 | Budd | 343/909 |
| 5,325,094 | A | | 6/1994 | Broderick et al. | 342/1 |
| 5,402,134 | A | | 3/1995 | Miller et al. | 343/742 |
| 5,519,408 | A | | 5/1996 | Schnetzer | |
| 5,525,954 | A | | 6/1996 | Komazaki et al. | 333/219 |
| 5,531,018 | A | | 7/1996 | Saia et al. | 29/622 |
| 5,532,709 | A | | 7/1996 | Talty | 343/819 |
| 5,534,877 | A | | 7/1996 | Sorbello et al. | 343/725 |
| 5,541,614 | A | | 7/1996 | Lam et al. | |
| 5,557,291 | A | | 9/1996 | Chu et al. | 343/725 |
| 5,589,845 | A | | 12/1996 | Yandrofski et al. | 343/909 |
| 5,611,940 | A | | 3/1997 | Zettler | 73/514 |
| 5,638,946 | A | | 6/1997 | Zavracky | 73/181 |
| 5,694,134 | A | | 12/1997 | Barnes | 343/700 |
| 5,721,194 | A | | 2/1998 | Yandrofski et al. | 505/210 |
| 5,874,915 | A | | 2/1999 | Lee et al. | 342/375 |
| 5,892,485 | A | | 4/1999 | Glabe et al. | 343/789 |
| 5,894,288 | A | | 4/1999 | Lee et al. | 343/770 |
| 5,905,466 | A | * | 5/1999 | Jha | 343/700 MS |
| 5,917,458 | A | | 6/1999 | Ho et al. | 343/909 |
| 5,923,303 | A | | 7/1999 | Schwengler et al. | |
| 5,945,951 | A | | 8/1999 | Monte et al. | 343/700 |
| 5,949,382 | A | | 9/1999 | Quan | 343/767 |
| 5,965,494 | A | * | 10/1999 | Terashima et al. | 505/210 |
| 6,005,519 | A | | 12/1999 | Burns | 343/700 |
| 6,040,803 | A | | 3/2000 | Spall | 343/700 |
| 6,054,659 | A | | 4/2000 | Lee et al. | 200/181 |
| 6,075,485 | A | | 6/2000 | Lilly et al. | 343/700 |
| 6,081,235 | A | | 6/2000 | Romanofsky et al. | 343/700 |
| 6,097,263 | A | | 8/2000 | Mueller et al. | 333/17.1 |
| 6,097,343 | A | | 8/2000 | Goetz et al. | 343/708 |
| 6,118,406 | A | | 9/2000 | Josypenko | 343/700 |
| 6,118,410 | A | | 9/2000 | Nagy | 343/713 |
| 6,127,908 | A | | 10/2000 | Bozler et al. | 333/246 |
| 6,154,176 | A | | 11/2000 | Fathy et al. | 343/700 |
| 6,166,705 | A | | 12/2000 | Mast et al. | 343/853 |
| 6,175,337 | B1 | | 1/2001 | Jasper, Jr. et al. | 343/770 |
| 6,191,724 | B1 | | 2/2001 | McEwan | 342/21 |
| 6,208,316 | B1 | | 3/2001 | Cahill | 343/909 |
| 6,218,978 | B1 | | 4/2001 | Simpkin et al. | 342/5 |
| 6,246,377 | B1 | | 6/2001 | Aiello et al. | 343/770 |
| 6,262,495 | B1 | * | 7/2001 | Yablonovitch et al. | 307/101 |

OTHER PUBLICATIONS

Sievenpiper, D., et. al., "High–Impedance Electromagnetic Surfaces with a Forbidden Frequency Band", *IEEE Transactions in Microwave Theory and Techniques*, vol. 47, No. 11, (Nov. 1999) pp. 2059–2074.

Sievenpiper, D., "High–Impedence Electromagnetic Surfaces", *Ph.D. Dissertation*, Dept. of Electrical Engineering, University of California, Los Angeles, CA, 1999.

Wu, S.T., et al., "High Birefringence and Wide Nematic Range Bis–tolane Liquid Crystals", *Appl. Phys. Lett.* vol. 74, No. 5, (Jan. 1999) pp. 344–346.

Bradley, T.W., et al., "Development of a Voltage–Variable Dielectric (VVD), Electronic Scan Antenna," *Radar 97*, Publication No. 449, pp. 383–385 (Oct. 1997).

Ellis, T.J. and G.M. Rebeiz, "MM–Wave Tapered Slot Antennas on Micromachined Photonic Bandgap Dielectrics," *1996 IEEE MTT–S International Microwave Symposium Digest*, vol. 2, pp. 1157–1160 (1996).

Linardou, I., et al., "Twin Vivaldi antenna fed by coplanar waveguide," *Electronics Letters*, vol. 33, No. 22, pp. 1835–1837 (Oct. 23, 1997).

Schaffner, J.H., et al., "Reconfigurable Aperture Antennas Using RF MEMS Switches for Multi–Octave Tunability and Beam Steering," *IEEE*, pp. 321–324 (2000).

Sievenpiper, D., et al., "Low–profile, four–sector diversity antenna on high–impedance ground plane," *Electronics Letters*, vol. 36, No. 16, pp. 1343–1345 (Aug. 3, 2000).

Sievenpiper, D. and Eli Yablonovitch, "Eliminating Surface Currents with Metallodielectric Photonic Crystals," *1998 IEEE MTT–S International Microwave Symposium Digest*, vol. 2, pp. 663–666 (Jun. 7, 1998).

* cited by examiner

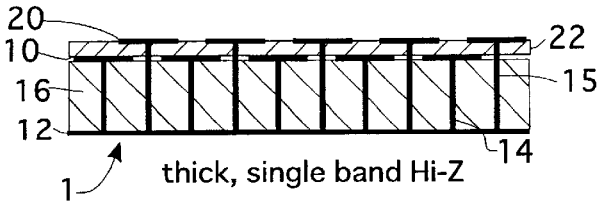
Prior Art Figure 2a
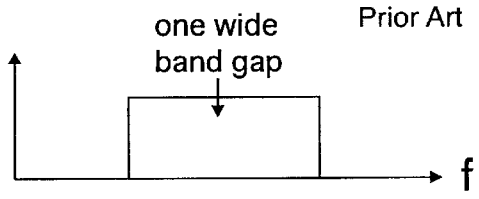
Prior Art
Figure 2a-1
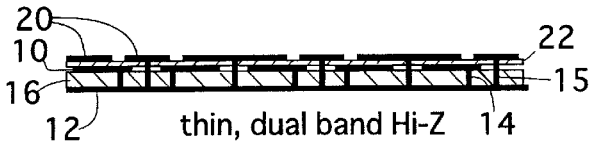
Figure 2b
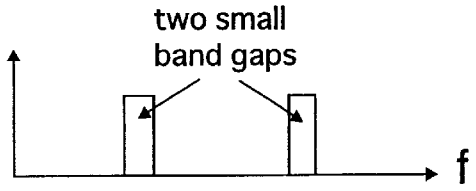
Figure 2b-1

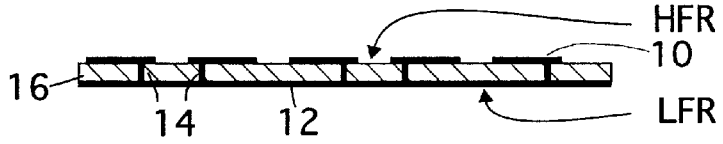
Figure 5a dual-band, two-layer structure using offset vias
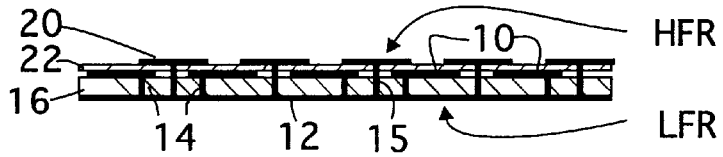
Figure 5b dual-band, three-layer structure using offset vias
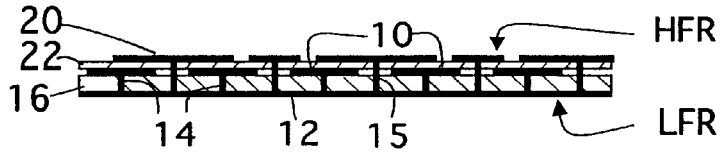
Figure 5c dual-band, three layer structure using asymmetric capacitors

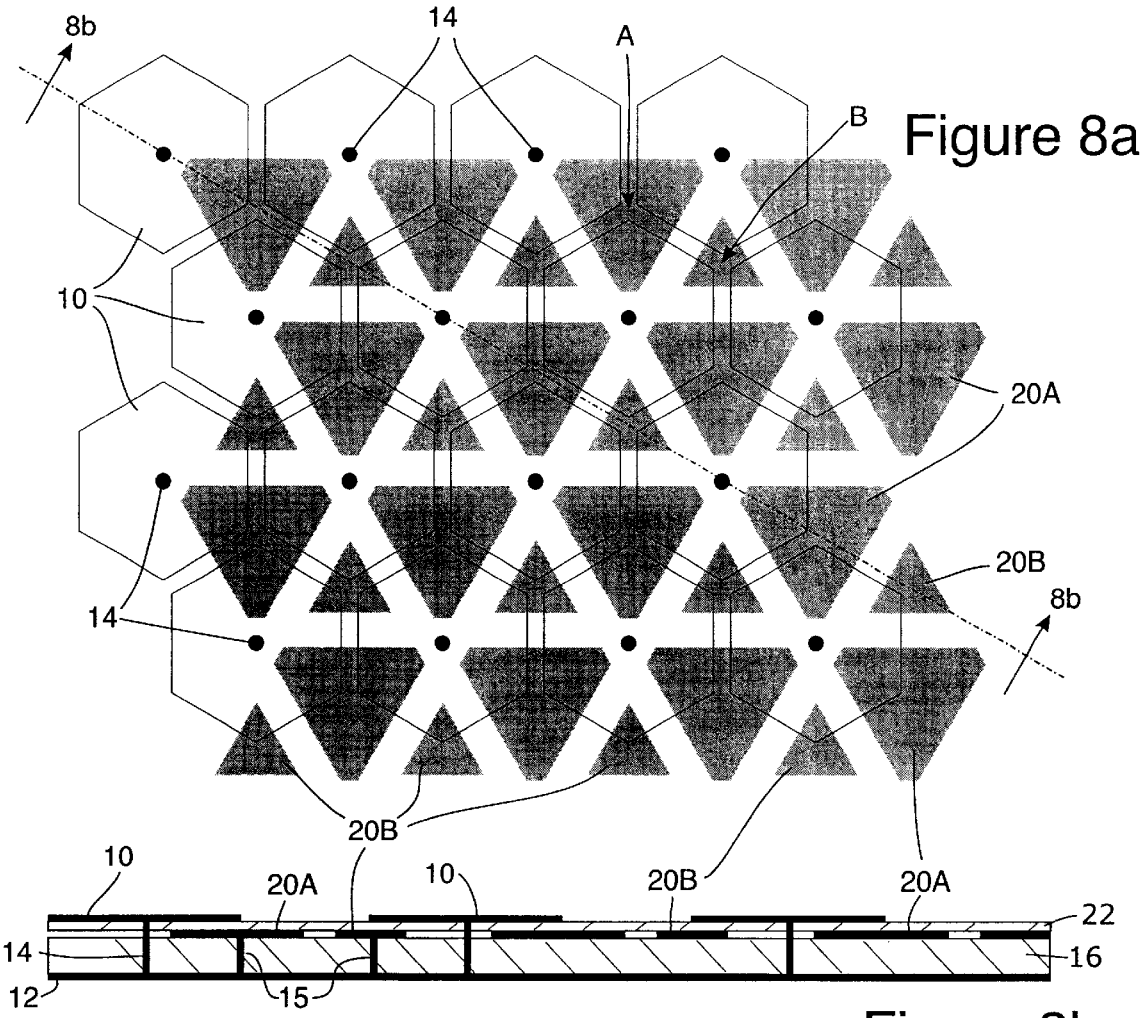
Figure 8a
Figure 8b
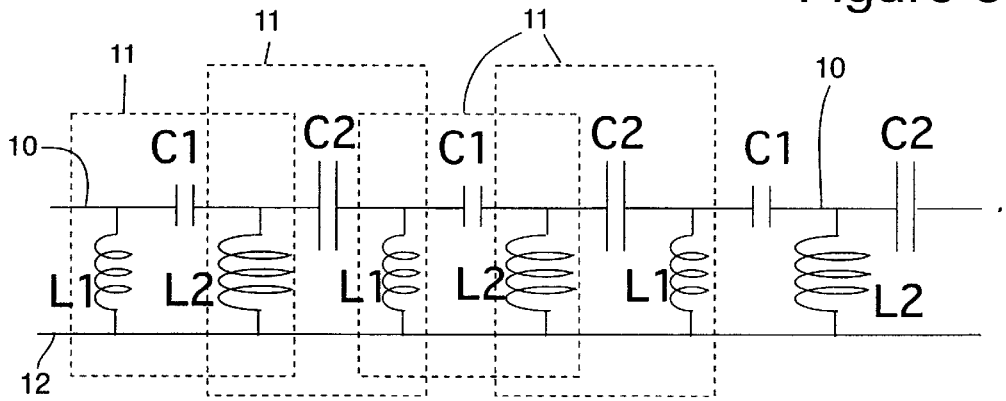
Figure 9

TEXTURED SURFACE HAVING HIGH ELECTROMAGNETIC IMPEDANCE IN MULTIPLE FREQUENCY BANDS

TECHNICAL FIELD

This invention relates to the field of antennas, and particularly to the area of high impedance ("Hi-Z") surfaces and to dual band, or multiple frequency band antennas.

BACKGROUND OF THE INVENTION AND REFERENCES TO RELATED APPLICATIONS

A high impedance (Hi-Z) surface is a ground plane which has been provided with a special texture that alters its electromagnetic properties. Important properties include the suppression of surface waves, in-phase reflection of electromagnetic waves, and the fact that thin antennas may be printed or otherwise formed directly on the Hi-Z surface.

An embodiment of a Hi-Z surface is the subject of a previously pending provisional application of D. Sievenpiper and E. Yablonovitch, "Circuit and Method for Eliminating Surface Currents on Metals", U.S. provisional patent application Ser. No. 60/079,953, filed on Mar. 30, 1998. Several improvements have been described in recently filed U.S. patent applications, including Ser. No. 09/520,503 for "A Polarization Converting Reflector" filed Mar. 8, 2000; 09/537,921 entitled "An End-Fire Antenna or Array on Surface with Tunable Impedance" filed Mar. 29, 2000; and U.S. patent application Ser. No. 09/537,922 entitled "An Electronically Tunable Reflector" filed Mar. 29, 2000, the disclosures of all of which are hereby incorporated herein by this reference.

This invention relates to techniques that extend the usefulness a Hi-Z surface by providing it with multiple-band operation, while preserving the inherent symmetry of the structure. This is an important development because it will allow for thin antennas operating in multiple bands. For example, one antenna could cover both GPS bands (1.2 and 1.5 GHz). A single antenna could also cover both the PCs band at 1.9 GHz. and the unlicensed band at 2.4 GHz, which is becoming increasingly important for such platforms as Bluetooth, new portable phones, and satellite radio broadcasting.

The present invention permits multiple band antennas to be much thinner than an ordinary Hi-Z surface having the same overall bandwidth, and also extends the maximum possible bandwidth of such surfaces by allowing them to have multiple high-impedance bands.

A high impedance (Hi-Z) surface consists of a flat sheet of metal covered by a periodic texture of metal plates which protrude slightly from the flat sheet. The Hi-Z surface is usually constructed as a two-layer or three-layer printed circuit board, in which the metal plates are printed on the top layers, and connected to the flat ground plane on the bottom layer by metal plated vias. One example of such a structure, consisting of a triangular lattice of hexagonal metal plates, is shown in FIG. 1 (the printed circuit boards are omitted in FIG. 1 for the sake of clarity in depicting the conductive elements). The metal plates have finite capacitance due to their proximity to their neighbors. They are linked by conducting paths which include the vias and the lower metal plate, and these paths contribute inductance. The result is a pattern of LC resonators, whose resonance frequency depends on the geometry of these elements. Each pair of adjacent metal plates in combination with their plated metal vias and the metal ground plane define a "cell" of the Hi-Z surface. A typical Hi-Z surface can have hundreds or even thousands of such cells.

The conventional high-impedance surface shown in FIG. 1 consists of an array of identical metal top plates or elements 10 disposed above a flat metal sheet or ground plane 12. It can be fabricated using printed circuit board technology with the metal plates or elements 10 formed on a top or first surface of a printed circuit board and a solid conducting ground or back plane 12 formed on a bottom or second surface of the printed circuit board. Vertical connections are formed as metal plated vias 14 in the printed circuit board, which connect the elements 10 with the underlying ground plane 12. The vias 14 are centered on elements 10. The metal members, comprising the top plates 10 and the vias 14, are arranged in a two-dimensional lattice of cells, and can be visualized as mushroom-shaped or thumbtack-shaped members protruding slightly from the flat metal surface 12. The thickness of the structure, which is controlled by the thickness of substrate 16, which is preferably provided by a printed circuit board, is much less than one wavelength $\lambda$ for the frequencies of interest. The sizes of the elements 10 are also kept less than one wavelength $\lambda$ for the frequencies of interest. The printed circuit board 16 is not shown in FIG. 1 for ease of illustration, but it can be readily seen in FIG. 2*a*. A large number of metal top plates may be utilized in forming a Hi-Z surface and only a small portion of the array of top plates 10 is shown in FIG. 1 for ease of illustration.

This structure has two important properties. It can suppress surface waves from propagating across the ground plane, and it provides a high surface impedance, which allows antennas to lie flat against it without being shorted out. However, these two properties only occur over a particular frequency band. The frequency and bandwidth of the high impedance region can be tuned by varying the capacitance and the inductance of the surface. The inductance depends on the thickness, which directly determines the bandwidth. The bandwidth is equal to $2\pi t/\lambda$, where t is the thickness, and $\lambda$ is the wavelength at resonance. For structures operating in the range of tens of GHz, a few millimeters of thickness provides bandwidth approaching an octave. However, for the important frequency regimes of S-band, and L-band, this thickness provides a bandwidth of only 10–20%. For UHF frequencies, several centimeters of thickness t provide no more than a few percent bandwidth.

Multiple band antennas often do not need to cover the entire frequency range spanning all bands of interest. However, with a multiple band Hi-Z surface such as that described herein, it is possible to cover several narrow bands that are separated by relatively wide bands of unused frequencies. In fact, this may be advantageous for suppressing out-of-band interference. For multiple band antennas, it is desirable to have a surface which provides a high impedance condition in multiple bands, where the bandwidth of each individual band is much less than the total frequency separation between them. This results in a thinner structure than one designed to cover all bands simultaneously, and can also suppress reception in other undesired signals. This is illustrated by FIGS. 2*a* and 2*b*. FIG. 2*a* shows a conventional two layer Hi-Z surface 1 with a relatively thick dielectric substrate 16. FIG. 2*a*-1 is a diagram of the single band gaps afforded by the Hi-Z surface of FIG. 2*a*. FIG. 2*b* shows an embodiment of a Hi-Z surface according to the present invention. FIG. 2*b*-1 is a diagram of the two band gaps afforded by the Hi-Z surface of FIG. 2*b*. The combined thickness of the two substrates 16 and 22 of the embodiment of FIG. 2*b* is less than the thickness of substrate 16 typically used in the prior art with Hi-Z surfaces.

Since the dual band embodiment of FIG. 2*b* has two bands each of which has a relatively small bandwidth compared to the embodiment of FIG. 2*a*, the dual band Hi-Z surface of FIG. 2*b* can be significantly thinner than the prior art structure of FIG. 2*a*. Thus dual band Hi-Z surface is both thinner than a comparable prior art surface, it is also better at suppressing out-of-band interference.

Techniques for producing multiple band Hi-Z surfaces might be summarized as providing multiple resonant structures in which local asymmetry splits a single mode into multiple modes, so that different internal regions of the Hi-Z surface can be identified with each distinct resonance. An important feature of these multiple band Hi-Z surfaces is that they are able to retain the same degree of overall symmetry as a traditional, single-band Hi-Z surface, although often with a larger unit cell size. This can be important because it has been found experimentally that conventional Hi-Z surfaces with at least threefold rotational symmetry allow a surface-mounted antenna to have any desired orientation without affecting the properties of the received or transmitted wave. Thus, using symmetrical structures simplifies the design of certain types of antennas, such as beam-switched diversity antennas. Conversely, if polarization control or adjustment is desired, the symmetry of the surface can also be broken, as is described U.S. patent application Ser. No. 09/520,503 noted above. This may be useful, for example, to allow conversion between linear and circular polarization. The present invention can be used with both symmetrical Hi-Z structures and with non-symmetrical Hi-Z structures.

In one aspect the present invention provides a high impedance surface having a reflection phase of zero in multiple frequency bands, the high impedance surface comprising: a ground plane; a plurality of conductive plates disposed in a first array spaced a distance from the ground plane, the distance being less than a wavelength of the radio frequency beam, said first array having a first lattice constant; and a plurality of conductive elements associated with said plurality of conductive plates, said plurality of conductive elements defining a second array, said second array having a lattice constant which can be the same as, or different than, the lattice constant of the first array.

The plurality of conductive elements can be provided by another array of conductive plates and/or by an array of conductive members which couple the plurality of conductive plates disposed in a first array to the ground plane.

In another aspect the present invention provides a method of making a high impedance surface exhibit a zero phase response at multiple frequencies, the method comprising the steps of: defining a high impedance surface having a ground plane and a plurality of conductive plates disposed in a first array spaced a distance from the ground plane, the distance being less than a wavelength of the radio frequency beam, defining a plurality of conductive elements associated with said plurality of conductive plates, said plurality of conductive elements connecting said plurality of conductive plates to said ground plane; and locating each of said plurality of conductive elements spaced a distance from a geometric center of an associated conductive plate and with all conductive elements associated with predetermined clusters of conductive plates being spaced in a direction pointing towards a common point for a given cluster.

BRIEF DESCRIPTION OF THE FIGURES

FIG. 2*a* is a side sectional view of a conventional Hi-Z surface having a relatively thick dielectric layer and a diagram of the single band gap afforded by the surface;

FIG. 2*a*-1 is a graph of the single wide band gap of the Hi-Z surface of FIG. 2*a;*

FIG. 2*b* is a side sectional view of a Hi-Z surface in accordance with the present invention having a relatively thin dielectric layer;

FIG. 2*b*-1 is a diagram of the two band gaps afforded by the Hi-Z surface of FIG. 2*b;*

FIGS. 5*a*–5*c* are side elevational views of different embodiments of multiple band Hi-Z surfaces;

FIG. 8*a* is a schematic plan view of a another embodiment of a three layer Hi-Z surface;

FIG. 8*b* is a section view through the three layer Hi-Z surface of FIG. 81 taken along line 8*b*–8*b* depicted on FIG. 8*a*; and FIG. 9 is an L-C equivalent circuit for the two layer Hi-Z surface disclosed herein showing how the invention operates in such a surface from a rather general perspective.

DETAILED DESCRIPTION OF THE PREFERRED EMBODIMENTS

Figure 1:
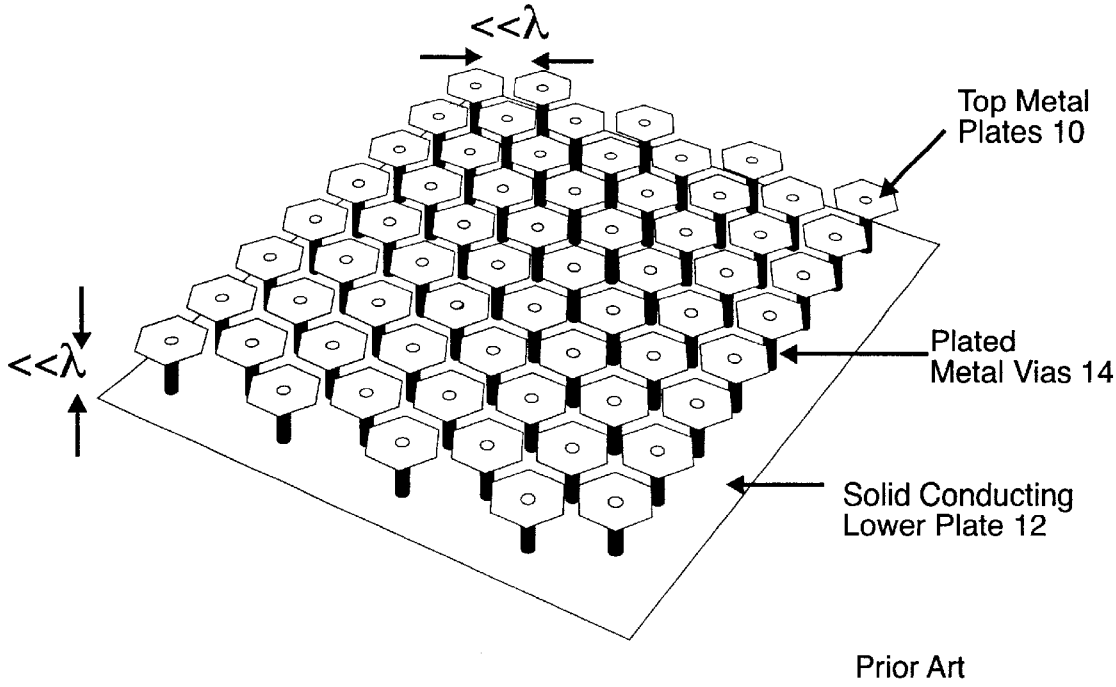
FIG. 1 is a perspective view of a conventional Hi-Z surface.
Figure 3A:
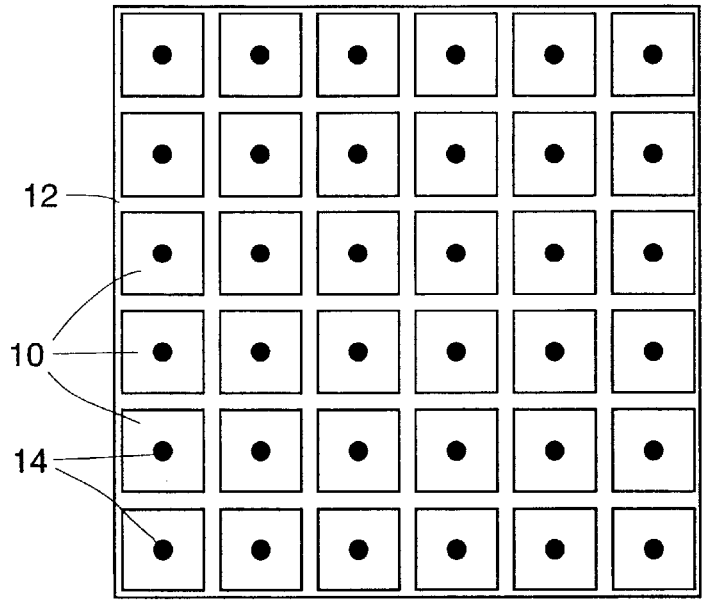
Figure 3a Prior Art
FIG. 3*a* depicts a conventional Hi-Z surface in plan view, showing the vias centered in their respective top plates.
Figure 3B:
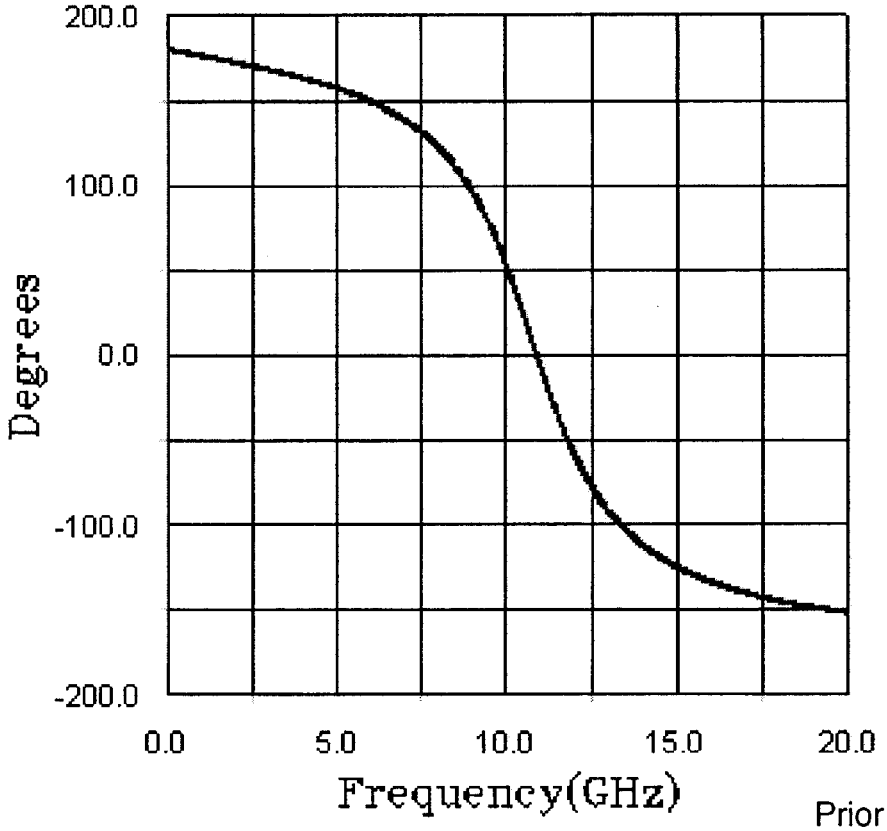
Prior Art Figure 3b
FIG. 3*b* is a graph of the reflection phase of the surface depicted in FIG. 3*a* and described herein, the reflection phase being characterized by a single resonance where the phase crosses through zero.

A conventional Hi-Z surface was simulated using HFSS software, for comparison to the new structures described herein. A conventional structure, shown in plan view in FIG. 3*a*, was constructed as an array of top elements 10 each 150 mils (3.8 mm) square arranged on a 160 mil (4.06 mm) lattice and disposed on a substrate 16 (see FIG. 2*a*) formed of 62 mil (1.6 mm) thick Duroid 5880 made by Rogers Corporation of Chandler, Ariz., USA. The conducting vias 14 were centered within the top plates 10 and each had a 20 mil (0.5 mm) diameter. The top plates and the bottom ground plane 12 were made of copper. For this analysis it was assumed that the extent of the array and the ground plane was very large and thus many more plates than that shown in figures typically make up an array. The HFSS software indicates that this conventional Hi-Z surface had a single resonance at about 11 Ghz as can be seen from FIG. 3*b*. The resonance can be identified as the frequency where the reflection phase passes through zero. At this frequency, a finite electric field is supported at the surface, and antennas can be placed directly adjacent to the surface without being shorted out. The practical bandwidth of the antenna is related to the slope of the phase curve and can be approximated as the region within which the phase falls within the range of $-\pi/2$ to $+\pi/2$.

Figure 4A:
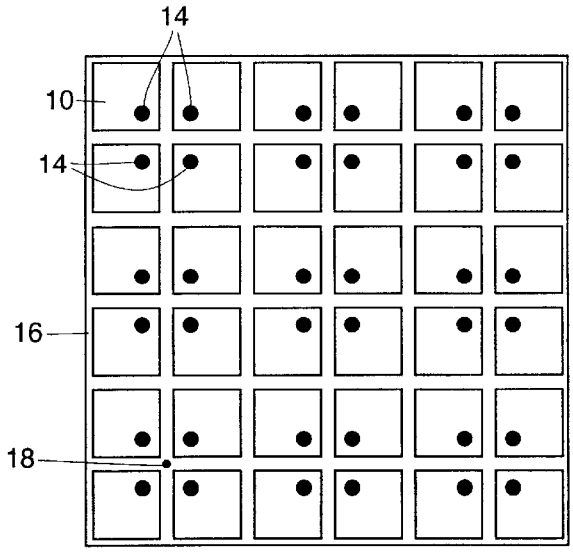
FIG. 4*a* depicts an embodiment of a Hi-Z surface having two resonances caused by shifting the locations of the vias into clusters of four vias, thereby doubling the lattice constant of the structure.

A Hi-Z surface can be made dual-band by moving the conductive vias 14 off the geometric centers of the top metal plates 10 in a manner which preserves, for example, and if desired, the original symmetry of the structure. One example of this is shown in FIG. 4*a* where the vias 14, which are preferably filled with metal to render them conductive, are clustered into groups of four (in this embodiment) and in which neighboring vias 14 in a cluster are located so that they appear to have been moved in the direction of a central point 18 around which a group or cluster of adjacent top plates 10 is symmetrically arranged. This arrangement preserves the symmetry of this structure, but now the unit cell contains four of the previous cells. Another way of looking at this is to consider the lattice constants of the depicted structures. The lattice constant of the vias 14 is twice that of the plates 10 (i.e. the distances at which the geometry of the vias 14 repeats is double that of the top plates 10 considered alone). The preservation of symmetry is important for the radiation properties of antennas built on this structure and also for the creation of two separate resonances. If all of the vias 14 are translated in the same direction, this has the effect of shifting the resonance frequency, but not splitting it. In that case the lattice constant of the vias 14 would be the same as that of the top plates 10. Furthermore, this structure is an isotropic in that the new resonance frequency depends on the polarization of the incoming wave.

Figure 4B:
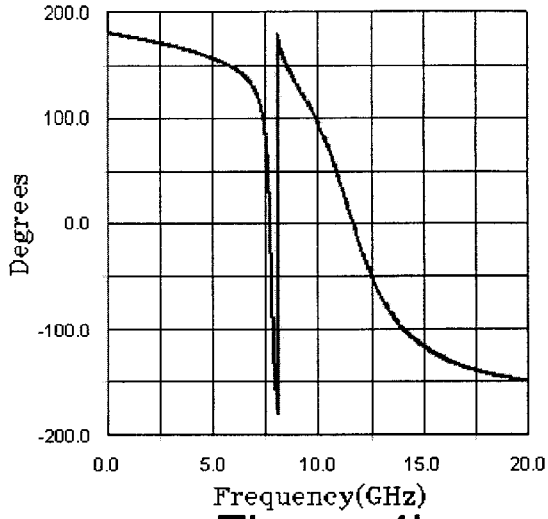
FIGS. 4*b*–4*d* are graphs of the reflection phase for three arrangements of the embodiment of FIG. 4*a*, the vias being relocated by different distances from the geometric centers of the top plates in each embodiment.
Figure 4C:
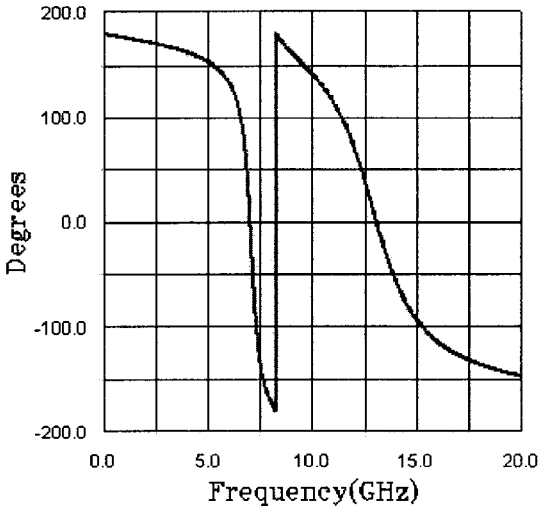
Figure 4D:
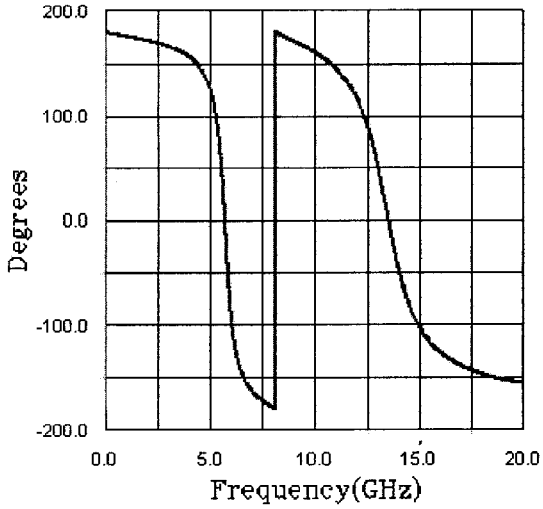

Using this technique of shifting or translating the vias, it is possible to provide a structure with two resonances, which can be varied independently. This is seen in the reflection phase graphs of FIGS. 4*b*–4*d*, in which the ratio of the two resonance frequencies is adjusted by varying the offset of the vias from 20 mils to 60 mils (0.5 mm to 1.5 mm). To produce the reflection phase graph of FIG. 4*b* the vias 14 were offset from the centers of the top plates 10 by 20 mils (0.5 mm). In FIG. 4*b* the resonance of the structure split into two resonances at 7.5 Ghz and 11.5 Ghz. For FIG. 4*c* the vias 14 were offset from the centers of the top plates 10 by 40 mils (1.0 mm), resulting in two resonances at 7 Ghz and 13 Ghz, while for FIG. 4*d* the vias 14 were offset from the centers of the top plates 10 by 60 mils (1.5 mm), resulting in resonances at 6 Ghz and 13.5 Ghz. For the embodiment of FIG. 4*a*, the sizes and spacings of the top plates 10 and the thickness of substrate 16 was maintained at the same values as tested for the embodiment of FIG. 3*a* so that the effect of translating the vias 14 could be isolated from other factors.

More than two resonances can be created by making a more complicated lattice, in which the unit cell consists of more than four plates. The more internal modes in each unit cell, the more resonance frequencies the structure will have. Structures can also be built to have similar properties which are not based on a square lattice, but instead on a triangular, hexagonal, or other-shaped lattice.

More complicated multi-band structures provide even greater flexibility in the construction of the reflection phases of the Hi-Z surfaces. Consider the side elevation views of FIGS. 5*a*–5*c*. The basic dual-band, two-layer structure with shifted vias heretofore described with reference to FIGS. 4*a*–4*d* is schematically shown by FIG. 5*a*. Dual-band, three-layer structures are shown in FIG. 5*b* and 5*c*. An additional insulating layer 22 and a top metal layer of an array of top plates 20 have been added to increase the capacitance between cells. The added array of top plates 20 have their own conducting vias 15 coupling them to the ground plane 12. These additions have the effect of lowering the resonance frequency for a given thickness and also tend to reduce the bandwidth of the Hi-Z surface. The addition of these additional layers adds complexity which can be exploited in making multiple band Hi-Z structures. In the embodiment of FIG. 5*b* only the vias 14 have been moved off center, with vias 15 remaining centered on their associated top plates 20. In the embodiment of FIG. 5*c*, the size of top plates 20 has been adjusted so that there are two groups of plates 20, one group being relatively larger in size and the other group being relatively smaller in size, but the vias 14, 15 are all centered on there respective plates 10, 20. Both embodiments have the effect of splitting the resonance, in a similar manner as was shown for the two-layer version. As such the resonance of a conventional Hi-Z surface can be made to have multiple resonances by (i) shifting the locations of the vias off center from their associated top plates in clusters towards a common point or (ii) adding a layer having a lattice of conductive top plates 20 having a different sizes compared to the size of the plates 10 of the underlying layer of plates 10. Both techniques can be combined, as is shown in FIG. 2*b*, to produce an even greater effect. As in the two-layer structures, more resonances can be added by making the unit cells more complicated. The added complexity makes the structure more expensive to manufacture, but the added complexity provides additional degrees of freedom for the designer designing a Hi-Z surface thus providing more control over the frequency and bandwidths of the resonances.

In each of the structures shown herein, different physical regions can be identified as contributing to each individual resonance. In FIGS. 5*a*–5*c*, a physical region contributing to the higher frequency resonance is labeled by an arrow HFR while a physical region contributing to the lower frequency resonance is labeled by an arrow LFR. In general, regions with larger capacitance or larger internal volume will result in a lower frequency resonance, while regions with smaller capacitance or smaller internal volume contribute to the higher frequency resonance. As the vias are moved and/or the plate sizes are adjusted, the sum of the capacitance and inductance is shifted from one region to another, and the uniform array of identical resonators are redefined into a mosaic of different resonators, which results in the multiple high-impedance conditions. Many degrees of freedom exist in structures of this type, including the ability to place more than one via in each unit cell or even on each plate, and an almost limitless arrangement of possible plate geometries.

Figure 6A:
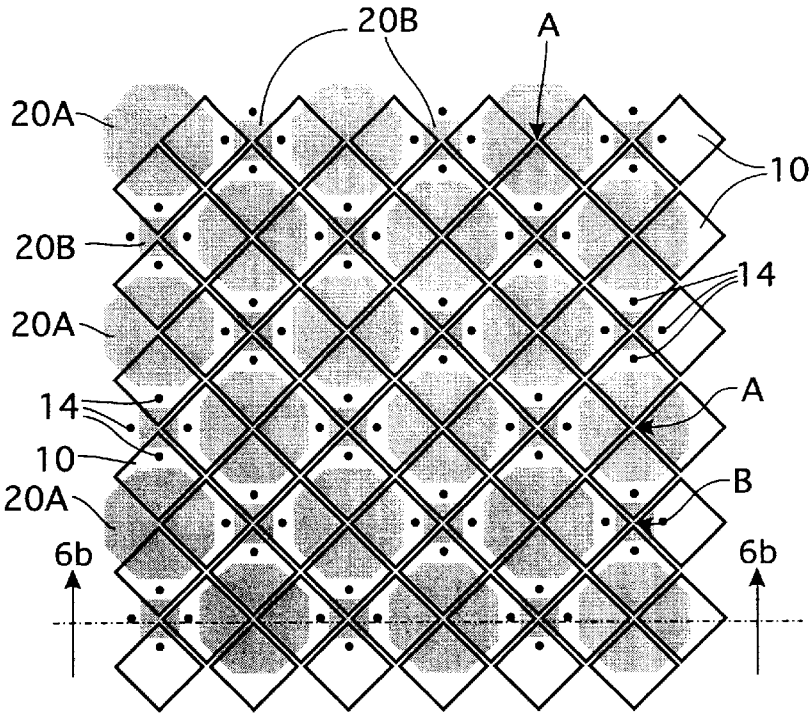
FIG. 6*a* is a schematic plan view of a three layer Hi-Z surface similar to that depicted by FIG. 2*b;*
Figure 6B:
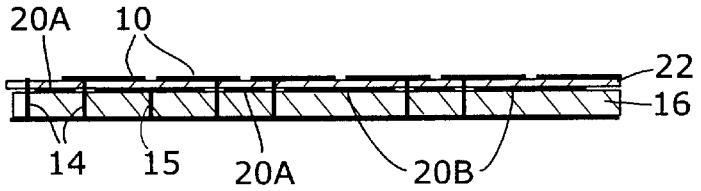
FIG. 6*b* is a section view through the three layer Hi-Z surface of FIG. 6*a* taken along line 6*b*–6*b* depicted on FIG. 6*a;*

An example of a three-layer structure which embodies both shifted vias and an altered patch geometry is shown in FIGS. 6*a* and 6*b*. This exemplary three layer structure has been simulated using the aforementioned HFSS software. In this exemplary three layer structure, the substrate 16 (not shown in FIG. 6*a*) is 62 mil (1.6 mm) thick FR4, and the insulating layer 22 (also not shown in FIG. 6*a*) is 2 mil (0.05 mm) thick Kapton polyimide. This structure was designed to be easily built, so the vias 14 for one layer are placed where gaps occur in the other layer. The layer of plates 20 includes an array of relatively larger plates 20A and an array of relatively smaller plates 20B. The plates 20A and 20B are preferably a metal such as copper which is conveniently used in printed circuit board technologies and are preferably formed using printed circuit board technology on substrate 16. The arrays of plates 20A and 20B are intermixed in a repeating pattern and each array has the same lattice constant in this embodiment. Plates 20B, in this exemplary three layer structure, are copper squares having 30 mil (0.75 mm) sides while plates 20A are copper octagons sized to fill the remaining area with a 20 mil (0.5 mm) clearance to plates 20B. The upper layer of plates 10 are, in this example, copper squares having 150 mil (3.8 mm) sides with a 10 mil (0.25 mm) clearance between adjacent plates 10 formed on substrate 22. Also, in this exemplary three layer structure, the array of plates 10 is rotated 45 degrees to the array of plates 20.

Plates 10 and 20 can be formed on their respective substrates using conventional printed circuit fabrication techniques, for example. The lower array of plates 20 may be electrically floating in this embodiment, as this does not particularly effect the electromagnetic properties of this embodiment of the Hi-Z surface or they may be connected to the ground plane 12 by metal filled conductive vias 15. The upper layer of plates 10 preferably have metal filled conductive vias 14 coupling plate 10 to the ground plane 16. The vias 14, in this exemplary three layer structure, are offset diagonally 70 mils (1.8 mm) from the centers of the plates 10. Tests indicate that not all of the metal filled vias 14 need be present. Indeed, tests show that the Hi-Z surface functions acceptably if only 50% of the metal filled vias 14 are present. However, since there is clearly room for the metal filled vias 14 in the exemplary three layer structure depicted by FIGS. 6*a* and 6*b*, it is believed that it is preferable to provide a via 14 for each plate 10. A via 15 can be optionally placed in the center of each floating plate 20 without affecting the resonance frequencies or in selected ones thereof (an optional conductive via is shown at numeral 15 in FIG. 6*b* for this layer—if conductive vias 15 are used then likely many conductive vias 15 would be used—vias 15 are not shown in FIG. 6*a* since they are optional in this embodiment).

Figure 7:
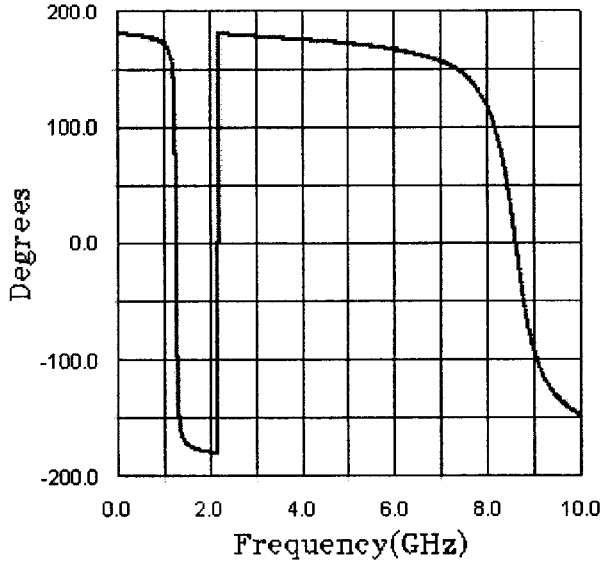
FIG. 7 is a graph of the reflection phase for an arrangement of the embodiment of FIGS. 6*a* and 6*b;*

This exemplary structure has two resonance frequencies which can be tuned over a broad range by adjusting both the plate geometry and the positions of vias 14. The reflection phase is shown in FIG. 7 for this exemplary three layer structure, and, as can be seen by reference to FIG. 7, the resonance frequencies occur at 1.3 GHz and 8.6 Ghz for this exemplary three layer structure.

In this embodiment the lower layer is depicted as being an array of plates 20 of two different configurations of plates, namely plates 20A and plates 20B. One plate configuration 20A is an relatively larger octagon and the other plate configuration 20B is a relatively smaller square. Other plate configurations are certainly possible, such as, for example, an array relatively larger and relatively smaller circular plates or, as another example, an array relatively larger and relatively smaller triangular plates. In the exemplary three layer structure depicted by FIGS. 6*a* and 6*b*, the invention includes a repeating pattern or array of conducting plates 20 having configurations of an appropriate size for the frequencies of interest and having a different lattice constant than the lattice constant of another adjacent layer of plates 10.

Also, in this exemplary three layer structure, the layer including plates 20 is referred to as the lower or bottom layer while the layer including plates 10 is referred to as the top or upper layer. However, as an inspection of FIGS. 6*a* and 6*b* will reveal, either layer can be on top of the other layer since there is certainly room to route conductive vias from either or both layers to the ground plane 12 irrespective of which layer forms the upper layer and which layer form the lower layer over the ground plane 12. For example, vias 15 may be provided at points A to connect the octagon plates 20A to the ground plane 12 and vias 15 may be provided at points B to connect the square plates 20B to the ground plane 12, which vias conveniently bypass plates 10 if plates 10 are arranged as the lower layer. If conducting vias 15 are used with plates 20, then the vias 15 may be offset from the geometric centers of plates 20 in an manner similar to that previously discussed with reference to FIGS. 4*a*–4*d*.

FIGS. 8*a* and 8*b* depict another embodiment of a three-layer structure which is generally similar to the embodiment of FIGS. 6*a* and 6*b*. In this embodiment the conductive vias 14 are centered on plates 10 as opposed to being shifted off-center as in the case of the embodiment of FIGS. 6*a* and 6*b*. Also, plates 10 and plates 20 (which again comprises two different sizes of plates, namely a subset or subarray of a relatively larger plates 20A and a subset or subarray of relatively smaller plates 20B both plate configurations being intermixed in a repeating pattern) have the same lattice constant. The numbering of the elements shown on FIGS. 8*a* and 8*b* is consistent with the numbering used for the embodiment of FIGS. 6a and 6b and the other embodiments. A ground plate 12 is present and the plates 10, 20A and 20B are all disposed above it. Plates 10 are preferably disposed on insulating layer 22 while plates 20A, 20B are preferably disposed on substrate 16. FIGS. 8*a* and 8*b* demonstrate that a three layer structure can utilize three different sizes of plates (plates 10 are of an intermediate size between the sizes of plates 20A and 20B) which all share a common lattice constant. In the embodiment of FIGS. 6*a* and 6*b* the plates have three different sizes and again plates 10 are of an intermediate size between the sized of plates 20A and 20B, but in the embodiment of FIGS. 6*a* and 6*b* the lattice constant changes between the two layers of plates depicted.

In the exemplary three layer structure of FIGS. 8*a* and 8*b*, the layer including plates 20 is referred to as the bottom or lower layer while the layer including plates 10 is referred to as the top or upper layer. However, as an inspection of FIGS. 8*a* and 8*b* will reveal, either layer can be on top of the other layer since there is certainly room to route conductive vias from either or both layers to the ground plane 12 irrespective of which layer forms the upper layer and which layer forms the lower layer over the ground plane 12. For example, vias may be provided at points A to connect plates 20A to the ground plane 12 and vias may be provided at points B to connect the plates 20B to the ground plane 12, which vias conveniently bypass the plates 10 if plates 10 are arranged on the lower layer. If conducting vias are used with plates 20, then their vias may be offset from the geometric centers of plates 20 in an manner similar to that previously discussed with reference to FIGS. 4*a*–4*d*, thereby providing still further flexibility.

Plates 10 and 20 can be formed on their respective substrates using conventional printed circuit fabrication techniques, for example. The lower array of plates 20 may be electrically floating in this embodiment, as this does not particularly effect the electromagnetic properties of this embodiment of the Hi-Z surface or they may be connected to the ground plane 12 by metal conductive vias 15. The upper layer of plates 10 preferably have metal conductive vias 14 coupling plate 10 to the ground plane 16. The vias 14, in this exemplary three layer structure, are centered on plates 10. Tests indicate that not all of the metal vias 14 need be present. Indeed, tests show that the Hi-Z surface functions acceptably if only 50% of the metal vias 14 are present. However, since there is clearly room for the metal vias 14 in the exemplary three layer structure depicted by FIGS. 8*a* and 8*b*, it is believed that it is preferable to provide a via 14 for each plate 10. A via 15 can be optionally placed in the center of each floating plate 20 without affecting the resonance frequencies or in selected ones thereof (two optional conductive vias are shown at numeral 15 in FIG. 8*b* for this layer—if conductive vias 15 are used then likely many conductive vias 15 would be used—vias 15 are not shown in FIG. 8*a* since they are optional in this embodiment).

With respect to the exemplary two insulating layer (layers 16 and 22) structures shown by FIGS. 6*a* and 6*b* and by FIGS. 8*a* and 8*b*, it has been determined that:

(1) If both upper and lower plates are coupled by conductive vias to the ground plane 12, then changing the plates sizes of either set of plates will produce a resonance split.

(2) If only the upper set of plates are coupled by conductive vias to the ground plane 12, then: (a) changing the size of the lower plates will produce a resonance split while (b) changing the size of the upper plates will not produce a resonance split.

(3) If only the lower set of plates are coupled by conductive vias to the ground plane 12, then: (a) changing the size of the lower plates will not produce a resonance split while (b) changing the size of the upper plates will produce a resonance split.

In other words, if only one set of plates are coupled by conductive vias to the ground plane 12, then the size of the other plates in the other layer should be changed in order to produce a resonance split. However, shifting the via locations from the geometric centers of their associated plates results in a split resonance no matter which set of plates is coupled by conductive vias to the ground. plane 12, provided that one subset of conductive vias is shifted in a first direction and a second subset of conductive vias are sifted a second, different direction.

Hi-Z surfaces which have only a single layer of plates can be made dual-band or multi-band using the same techniques of translating the vias and/or of varying the size of the plates as discussed above. Since the vias and the plates affect the inductance and the capacitance of the cavities, respectively, they have different effects on the bandwidth of the two resonances which are created. It has been observed that Hi-Z surfaces in which only the sizes of the plates are varied. have a broad lower resonance, and a narrow upper resonance. Conversely, Hi-Z surfaces in which only the conductive vias are moved have a narrow lower resonance and a broad upper resonance. In general, by controlling both the via offset position and the plate sizes, one can produce a dual band Hi-Z surface with resonances having generally any desired bandwidth ratio, and such a surface only need have a single layer of plates 10 disposed adjacent a ground plane 12. Furthermore, by using a more complicated geometries, for example, by using multiple layers of plates, some (or all) of which have multiple sizes of plates (and preferably different sizes of plates in adjacent layers), one can introduce additional resonances using these techniques to produce structures with zero reflection phase at more than two frequencies.

In the most general sense of one aspect of this invention, this invention provides a technique for creating multiple resonances in a Hi-Z surface which involves altering the capacitance or inductance of a subset of the cells. This is illustrated in FIG. 9, which depicts both the capacitors and the inductors being altered in every other cell 11. One may choose to change the capacitance, the inductance, or both. In a multi-layer, two-dimensional structure, the capacitance is generally changed by adjusting the overlap area of the plates, while the inductance is changed by adjusting the via positions. However, other methods of adjusting these parameters can be used, such as varying the thickness or dielectric constant of the insulator in the capacitors, or by varying the geometry of the inductors or the material surrounding the inductors. This invention is not limited to the examples given, and in general it includes any me of varying the capacitance or inductance of a subset of the cells in the periodic structure in the ways described herein, for example, to produce two or more resonances.

A large number of plates or elements 10, 20 may be utilized in forming a Hi-Z surface and only a small portion of the plates or elements 10, 20 forming the arrays is shown in the figures for ease of illustration.

In the embodiments depicted in the accompanying drawings, the Hi-Z surface is depicted as being planar. It need not be planar in use. On the contrary, the Hi-Z surface may assume a non-planar configuration, if desired. For example, the Hi-Z surface may assume a shape which conforms to the outer surface of a vehicle, such as a automobile, truck, airplane, military tank, to name just as few exemplary vehicles. The Hi-Z surface, in use, typically has. a plurality of antenna elements mounted thereon (indeed, the antenna elements may be made integral with the surface and thus the surface and the antennas may be very thin having a thickness under I cm for example) and the Hi-Z surface may be arranged for use with terrestrial or satellite communication systems. A Hi-Z surface of the type disclosed herein which has at least two resonances and which is provided with suitable antennas effective at those resonances would be highly desirable for use with terrestrial vehicles (for example. automobiles) since the Hi-Z surface and antennas (i) would be very thin in height and could be configured to follow the outer shape of the roof, for example, of the vehicle (and thus be very aerodynamic and also effectively hide the antennas from sight as the exposed surface of the H-Z surface and antennas could easily conform to and mate with the outer surface configuration of the vehicle) and (ii) be an effective antenna for use, for example, with cellular telephone services (which currently occupy multiple frequency bands), and/or with direct satellite broadcast services (for example, television and/or radio), and/or with global satellite positioning system satellites and/or with internet services from terrestrial and/or satellite-based providers. Given the thinness of an antenna using the multiple resonant Hi-Z surface disclosed herein, the antenna may be used in other many other applications. One such application is an antenna in hand-held cellular telephones which currently operate in two or three frequency bands.

The antenna elements which may be used with the Hi-Z surface can be selected from a wide range of antenna element types. For example, the antenna elements may form simple dipole antennas or may form patch or notch antennas. By mixing the antenna types utilized (for example, one type in one frequency band and another antenna type in a different frequency band) the antenna can respond to different polarizations of received signals in the different frequencies bands and when used as a transmitting antenna, transmit different polarizations in such bands.

Having described the invention in connection with certain embodiments thereof, modification will now certainly suggest itself to those skilled in the art. As such, the invention is not to be limited to the disclosed embodiments except as required by the appended claims.

What is claimed is:

1. A high impedance surface having a reflection phase of zero in multiple frequency bands, said high impedance surface including:

(a) a ground plane;

(b) a plurality of conductive plates disposed in a first array spaced a distance from the ground plane, the distance being less than a wavelength of a radio frequency in said multiple frequency bands, said first array having a first lattice constant,; and (c) a plurality of conductive elements associated with said plurality of conductive plates, said plurality of conductive elements defining a second array, said second array having a lattice constant greater than the lattice constant of the first arrays.

2. The high impedance surface of claim 1 wherein the lattice constant of the second array is an integer multiple of the lattice constant of the first array.

3. The high impedance surface of claim 2 wherein the plurality of conductive elements connect at least selected ones of the plurality of conductive plates to said ground plane.

4. The high impedance surface of claim 2 wherein the plurality of conductive elements connect at least a majority of the plurality of conductive plates to said ground plane.

5. The high impedance surface of claim 4 further including a dielectric layer disposed between said ground plane and the plurality of conductive plates disposed in said first array, said plurality of conductive elements being defined by conductive vias in said dielectric layer.

6. The high impedance surface of claim 5 further including a second plurality of conductive plates, the second plurality of plates being disposed in said second array and being spaced a second distance from said ground plane.

7. The high impedance surface of claim 6 further including a second dielectric layer disposed between the plurality of conductive plates disposed in said first array and the second plurality of conductive plates.

8. The high impedance surface of claim 7 further including a second plurality of conductive elements connecting at least selected ones of the second plurality of conductive plates to said ground plane.

9. The high impedance surface of claim 8 wherein the second plurality of conductive elements are arranged in said second array and contact at least selected ones of the second plurality of conductive plates at their geometric centers.

10. The high impedance surface of claim 8 wherein the second plurality of conductive elements are arranged in a third array having a lattice constant greater than said second array and contact at least selected ones of the second plurality of conductive plates at points spaced from their geometric centers.

11. The high impedance surface of claim 6 wherein the second plurality of conductive plates includes a plurality of plates of a relatively larger size and a plurality of plates of a relatively smaller size.

12. The high impedance surface of claim 1 wherein the plurality of plates of a relatively larger size in said second plurality of conductive plates have a generally octagonal configuration.

13. The high impedance surface of claim 6 wherein the plurality of conductive plates disposed in said first array are of a uniform size and configuration.

14. The high impedance surface of claim 2 wherein the plurality of conductive elements include a second plurality of conductive plates, the second plurality of plates being disposed in said second array spaced a second distance from the ground plane.

15. The high impedance surface of claim 14 further including a first dielectric layer disposed between the plurality of conductive plates disposed in said first array and the second plurality of conductive plates and a second dielectric layer disposed between said ground plane and the plurality of conductive plates disposed in said second array.

16. The high impedance surface of claim 15 further including a plurality of conductive vias connecting at least selected ones of the second plurality of conductive plates to said ground plane.

17. The high impedance surface of claim 15 further including a plurality of conductive vias connecting at least selected ones of the plurality of conductive plates in the first array to said ground plane.

18. The high impedance surface of claim 17 wherein the plurality of conductive vias are arranged in a third array to contact at least selected ones of the plurality of conductive plates in the first array at their geometric centers.

19. The high impedance surface of claim 17 wherein the plurality of conductive vias are arranged in a third array having a lattice constant greater than said first array and contacting at least selected ones of the plurality of conductive plates in the first array at points spaced from their geometric centers.

20. The high impedance surface of claim 14 wherein the second plurality of conductive plates includes a plurality of plates of a relatively larger size and a plurality of plates of a relatively smaller size.

21. The high impedance surface of claim 20 wherein the plurality of plates of a relatively larger size in said second plurality of conductive plates have a generally octagonal configuration.

22. The high impedance surface of claim 14 wherein the plurality of conductive plates disposed in said first array are of a uniform size and configuration.

23. A high impedance surface having a reflection phase of zero in multiple frequency bands, said high impedance surface including:

(a) a ground plane on a dielectric surface;

(b) a plurality of conductive plates disposed in an array on said dielectric surface spaced a distance from the ground plane, the distance being less than a wavelength of a radio frequency in said multiple frequency bands; and (c) a plurality of conductive vias in said dielectric surface, said plurality of conductive vias being associated with said plurality of conductive plates, said plurality of conductive vias defining a second array, said vias of second array being spaced from a geometric center of each conductive plate disposed in the first array, first selected ones of said plurality of conductive vias being spaced in a first direction from said geometric center and second selected ones of said plurality of conductive vias being spaced in a second direction from said geometric center, said second direction being different than said first direction.

24. The high impedance surface of claim 23 wherein, said array of conductive plates has a first lattice constant and wherein the array of conductive vias also has a lattice constant, the lattice constant of the array of conductive plates being an integer multiple of the lattice constant of the array of conductive vias.

25. The high impedance surface of claim 24 wherein the plurality of conductive vias connect at least selected ones of the plurality of conductive plates to said ground plane.

26. A method of making a high impedance surface exhibit a multiple frequency zero phase response to an impinging radio frequency emission, said method including the steps of:

(a) defining a high impedance surface having a ground plane and a plurality of conductive plates disposed in a first array spaced a distance from the ground plane, the distance being less than a wavelength of the radio frequency emission, (b) defining a plurality of conductive elements associated with said plurality of conductive plates, said plurality of conductive elements connecting said plurality of conductive plates to said ground plane; and (c) locating each of said plurality of conductive elements spaced a distance from a geometric center of an associated conductive plate and with all conductive elements associated with predetermined clusters of conductive plates being spaced in a direction pointing towards a common point for a given cluster.

27. The method of claim 26 further including:

(d) defining a second plurality of conductive plates disposed in a second array spaced another distance from the ground plane, the second array having a different lattice constant than a lattice constant of the first array.

28. The method of claim 27 wherein the lattice constant of the second array is an integer multiple of the lattice constant of the first array.

29. The method of claim 27 wherein the second plurality of conductive plates includes a group of relatively larger plates and a group of relatively smaller plates.

30. A method of making a high impedance surface exhibit a multiple frequency zero phase response, said method including the steps of:

(a) defining a high impedance surface having a ground plane and a plurality of conductive plates disposed in a first array spaced a distance from the ground plane, the distance being less than a wavelength of a frequency in the multiple frequency zero phase response, (b) defining a second plurality of conductive plates in a second array spaced another distance from the ground plane; and (c) defining the second array to have a different lattice constant than a lattice constant of the first array.

31. The method of claim 30 wherein the lattice constant of the second array is an integer multiple of the lattice constant of the first array.

32. The method of claim 31 wherein the lattice constant of the second array is double the lattice constant of the first array.

33. The method of claim 30 further including:

(d) defining a plurality of conductive elements associated with said second plurality of conductive plates, said plurality of conductive elements connecting said second plurality of conductive plates to said ground plane.

34. The method of claim 33 further including:

(e) locating each of said plurality of conductive elements spaced a distance from a geometric center of an associated conductive plate and with all conductive elements associated with predetermined clusters of conductive plates being spaced in a direction pointing towards a common point for a given cluster.

35. The method of claim 30 wherein the plurality of conductive plates disposed in the first array includes a group of relatively larger plates and a group of relatively smaller plates.

36. A method of making a high impedance surface exhibit a multiple frequency zero phase response, said method including the steps of:

defining a ground plane;

disposing a plurality of conductive plates in a first array spaced a distance from the ground plane, the distance Wingress than-a wavelength of a radio frequency associated with a zero phase response of said high impedance surface, said first array having a first lattice constant; and disposing a plurality of conductive elements in a second array and associated with said plurality of conductive plates, said second array having a lattice constant-greater than the lattice constant of the first array.

37. The method of claim 36 wherein the plurality of conductive elements in the second array ohmicly connect said plurality of conductive plates in the first array to said ground plane.

38. The method of claim 36 wherein the plurality of conductive elements in the second array is defined as a second plurality of conductive plates in said second array spaced a distance from the ground plane, the distance being less than a wavelength of a radio frequency in said multiple frequency bands and the distance by which the second plurality of conductive plates is spaced from the ground plane being different than the distance by which the plurality of conductive plates in the first array is spaced from the ground plane.

39. A high impedance surface having a reflection phase of zero in multiple frequency bands, said high impedance surface including:

(a) a ground plane;

(b) a first plurality of conductive plates disposed in a first array spaced a distance from the ground plane, the distance being less than a wavelength of a radio frequency in said multiple frequency bands; and (c) a second plurality of conductive plates disposed in a second array spaced a distance from the ground plane, the distance being less than a wavelength of a radio frequency in said multiple frequency bands, said second plurality containing at least two sub-arrays, with one subarray having larger plates-than the other subarray.

40. The high impedance surface of claim 39 wherein the first array has a lattice constant, the second array has a lattice constant, and the lattice constant of the second array is an integer multiple of the lattice constant of the first array.

41. The high impedance surface of claim 39 wherein the first array has a lattice constant, the second array has a lattice constant equal to the lattice constant of the first array.

42. The high impedance surface of claim 39 wherein the larger plates of said one sub-array are larger than the plates of said first array.

43. The high impedance surface of claim 39 wherein the larger plates of said one sub-array are smaller than the plates of said first array.

44. The high impedance surface of claim 39 wherein the plates of said second array are coupled to said ground plane by conductive elements.

45. The high impedance surface of claim 39 wherein the plates of said first and second arrays are disposed on respective first and second dielectric substrates.

46. The high impedance surface of claim 45 wherein the ground plane is disposed on one of said first and second dielectric substrates.

* * * * *

UNITED STATES PATENT AND TRADEMARK OFFICE

CERTIFICATE OF CORRECTION

PATENT NO. : 6,483,481 B1 
DATED : November 19, 2002
INVENTOR(S) : Daniel Sievenpiper et al.

It is certified that error appears in the above-identified patent and that said Letters Patent is hereby corrected as shown below:

Title page,
Item [73], Assignee, change "Hrl Laboratories, LLC" to -- HRL Laboratories, LLC --

Signed and Sealed this

Twenty-fourth Day of June, 2003

JAMES E. ROGAN
*Director of the United States Patent and Trademark Office*